US011529721B2

(12) United States Patent
Agashe et al.

(10) Patent No.: US 11,529,721 B2
(45) Date of Patent: Dec. 20, 2022

(54) WRENCH DEVICE, AND A METHOD OF AUTOMATICALLY ADJUSTING TORQUE FOR A FASTENER OF A PIECE OF EQUIPMENT

(71) Applicant: SAMSUNG ELECTRONICS CO., LTD., Suwon-si (KR)

(72) Inventors: Shashank Shrikant Agashe, Bangalore (IN); Sameera Bharadwaja Hayavadana, Bangalore (IN); Byeongeon Lee, Yongin-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 448 days.

(21) Appl. No.: 16/697,941

(22) Filed: Nov. 27, 2019

(65) Prior Publication Data

US 2021/0078147 A1 Mar. 18, 2021

(30) Foreign Application Priority Data

Sep. 17, 2019 (IN) ..... 201941037372

(51) Int. Cl.
*B25B 23/142* (2006.01)

(52) U.S. Cl.
CPC ..... *B25B 23/1425* (2013.01)

(58) Field of Classification Search
CPC ..... B25B 23/1425; B25B 23/1427; B25B 23/142; B25B 23/14; B25B 23/1475
See application file for complete search history.

(56) References Cited

U.S. PATENT DOCUMENTS

| | | | | |
|---|---|---|---|---|
| 9,205,544 | B2 | 12/2015 | Yamamoto et al. | |
| 9,743,971 | B2 | 8/2017 | Belkoff et al. | |
| 2011/0113613 | A1 | 5/2011 | Gamboa et al. | |
| 2016/0218807 | A1 | 7/2016 | Tran | |
| 2017/0043462 | A1* | 2/2017 | Brebant | B60C 23/0494 |
| 2021/0379743 | A1* | 12/2021 | Schneider | H02K 11/21 |

FOREIGN PATENT DOCUMENTS

| | | |
|---|---|---|
| CN | 203380833 | 1/2014 |
| WO | 2016209818 | 12/2016 |

* cited by examiner

*Primary Examiner* — Lee D Wilson
(74) *Attorney, Agent, or Firm* — F. Chau & Associates, LLC

(57) ABSTRACT

A wrench device includes a data receiving component configured to receive, from a transceiver associated with a piece of equipment, information related to a fastener included in the piece of equipment, and a torque value corresponding to the fastener. The wrench device further includes an image sensor configured to capture an image of the fastener, a processor, and a memory communicatively coupled to the processor. The memory stores processor-executable instructions, which, on execution, cause the processor to receive the image of the fastener from the image sensor, receive the information related to the fastener from the data receiving component, identify the fastener by correlating the received image with the information related to the fastener, extract the torque value corresponding to the fastener based on the information upon identification of the fastener, and adjust a torque of the fastener based on the extracted torque value.

7 Claims, 6 Drawing Sheets

WRENCH DEVICE, AND A METHOD OF AUTOMATICALLY ADJUSTING TORQUE FOR A FASTENER OF A PIECE OF EQUIPMENT

CROSS-REFERENCE TO RELATED APPLICATIONS

This application claims priority under 35 U.S.C. § 119 to Indian Patent Application No. 201941037372 filed on Sep. 17, 2019, the disclosure of which is incorporated by reference herein in its entirety.

TECHNICAL FIELD

Exemplary embodiments of the present disclosure relate to a wrench device, and more particularly, to a wrench device capable of automatically adjusting the torque of a fastener of a piece of equipment, as well as a method thereof.

DISCUSSION OF THE RELATED ART

One of the most repetitive tasks during a typical maintenance procedure is to tighten nuts and bolts using a wrench device. Some examples of such procedures in the semiconductor industry may include, for example, closing an equipment chamber door, panel, pump, view-ports, etc.

During tightening of a nut/bolt, it is important to apply the exact appropriate torque and to follow the appropriate sequence. For example, while replacing the platen of an etch chamber, over-tightening may cause a change in the coupling of Radio Frequency (RF) power. This is tedious and time consuming, because a technician must constantly refer to the Standard Operating Procedure (SOP) document and manually adjust the torque settings. This may also increase the chance of failure if one of the steps is not executed properly.

Currently, a wrench device may use, for example, Quick Response (QR) codes or other physical markers affixed to the nuts/bolts for identifying the appropriate corresponding torque values. In many cases such as, for example, medical applications, the semiconductor industry, etc., application of such markers is detrimental to the performance of the equipment.

SUMMARY

According to an exemplary embodiment, a wrench device includes a data receiving component configured to receive, from a transceiver associated with a piece of equipment, information related to a fastener included in the piece of equipment, and a torque value corresponding to the fastener. The wrench device further includes an image sensor configured to capture an image of the fastener, a processor, and a memory communicatively coupled to the processor. The memory stores processor-executable instructions, which, on execution, cause the processor to receive the image of the fastener from the image sensor, receive the information related to the fastener from the data receiving component, identify the fastener by correlating the received image with the information related to the fastener, extract the torque value corresponding to the fastener based on the information upon identification of the fastener, and adjust a torque of the fastener based on the extracted torque value.

According to an exemplary embodiment, a method of automatically adjusting a torque of a fastener of a piece of equipment includes receiving, by a wrench device and from a transceiver associated with the piece of equipment, information related to the fastener and a torque value corresponding to the fastener. The method further includes receiving, by the wrench device, an image of the fastener from an image sensor included in the wrench device. The method further includes identifying the fastener, by the wrench device, by correlating the received image with the information related to the fastener. The method further includes extracting, by the wrench device, the torque value corresponding to the fastener based on the information upon identification of the fastener. The method further includes adjusting, by the wrench device, the torque of the fastener based on the extracted torque value.

According to an exemplary embodiment, an apparatus includes a processor and a memory communicatively coupled to the processor. The memory stores processor-executable instructions, which, on execution, cause the processor to receive an image of a fastener included in a piece of equipment from an electronic device in communication with the apparatus, receive information related to the fastener, and a corresponding torque value, identify the fastener by correlating the received image with the received image to identify the fastener, extract the torque value corresponding to the fastener based on the information upon identification of the fastener, and provide the torque value to a wrench device associated with the electronic device for automatically adjusting a torque of the fastener based on the extracted torque value.

According to an exemplary embodiment, a method of automatically adjusting a torque of a fastener of a piece of equipment includes receiving, by an apparatus associated with a wrench device, an image of the fastener from an electronic device associated with the apparatus. The method further includes receiving, by the apparatus, information related to the fastener, and a corresponding torque value. The method further includes identifying the fastener by correlating, by the apparatus, the received image with the received information. The method further includes extracting, by the apparatus, the corresponding torque value based on the information upon identification of the fastener. The method further includes providing, by the apparatus, the extracted torque value to the wrench device for adjusting the torque of the fastener based on the extracted torque value.

BRIEF DESCRIPTION OF THE DRAWINGS

The above and other features of the present disclosure will become more apparent by describing in detail exemplary embodiments thereof with reference to the accompanying drawings, in which.

DETAILED DESCRIPTION

Figure 1A:
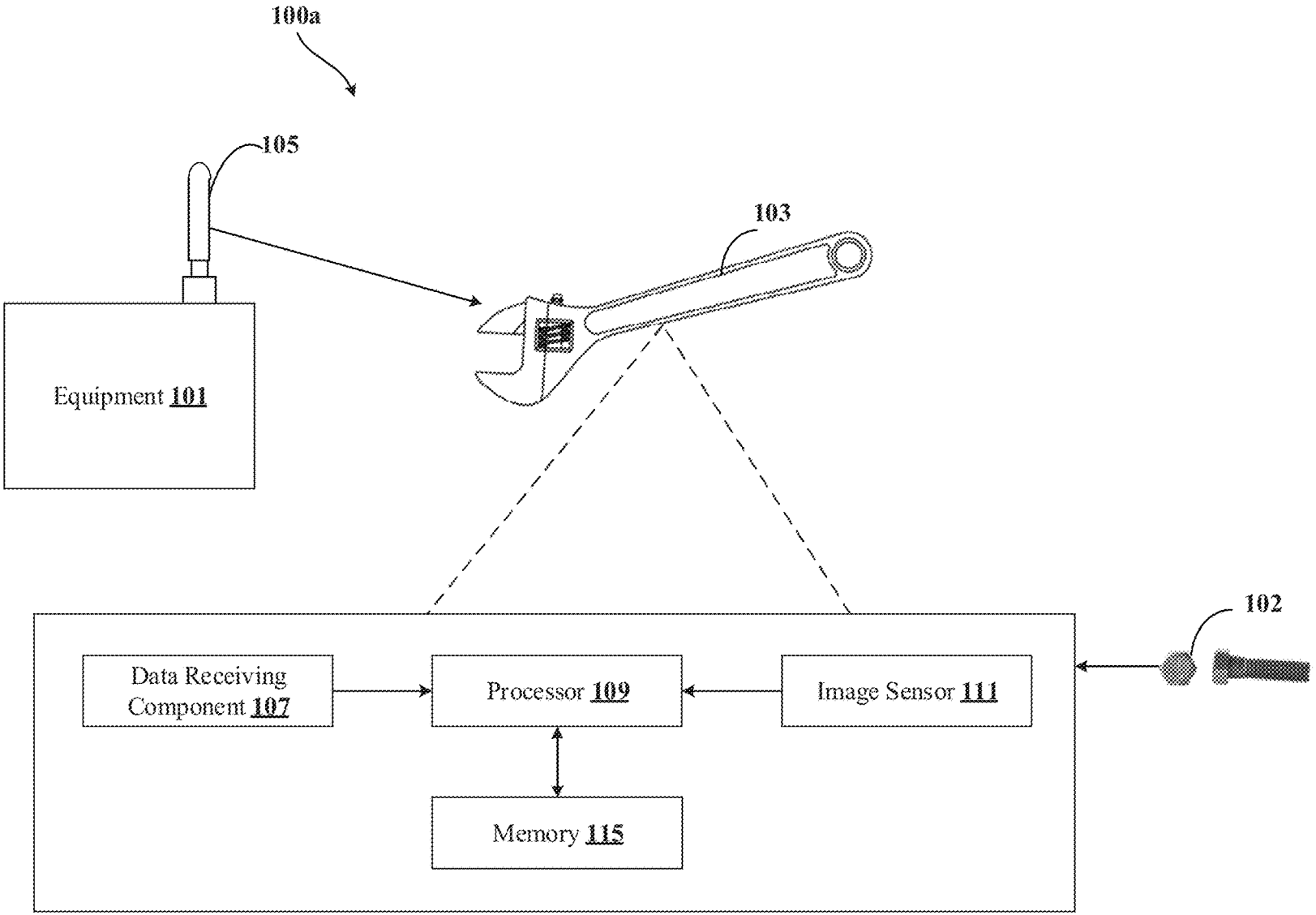
FIGS. 1*a* to 1*c* each show an exemplary environment for automatically adjusting the torque of a fastener of a piece of equipment according to an exemplary embodiment of the present disclosure.

Exemplary embodiments of the present disclosure will be described more fully hereinafter with reference to the accompanying drawings. Like reference numerals may refer to like elements throughout the accompanying drawings.

It should be understood that descriptions of features or aspects within each exemplary embodiment should typically be considered as available for other similar features or aspects in other exemplary embodiments, unless the context clearly indicates otherwise.

It should be further understood that the singular forms "a", "an" and "the" are intended to include the plural forms as well, unless the context clearly indicates otherwise.

Exemplary embodiments of the present disclosure relate to a wrench device, and a method of automatically adjusting the torque of a fastener of a piece of equipment. The wrench device may include, for example, a data receiving component, which is capable of receiving information related to one or more fasteners in the piece of equipment, and corresponding torque values. The data receiving component may receive the information from a transceiver associated with (e.g., included in) the piece of equipment. The transceiver may be, for example, a light tower included in the piece of equipment. The information may include, for example, an image of each of the one or more fasteners, a type of each of the one or more fasteners, and/or a torque value corresponding to each of the one or more fasteners.

The wrench device may also include an image sensor. The image sensor may capture an image of a fastener for which the torque is to be determined. The wrench device may correlate the image of the fastener and the information related to the one or more fasteners. Based on this correlation, the wrench device may identify the fastener. Once the fastener is identified, the wrench device may extract the torque value corresponding to the identified fastener. The wrench device may adjust the fastener based on the torque value. In this manner, exemplary embodiments provide a wrench device which can automatically adjust the torque of a fastener of a piece of equipment. As a result, markers may be omitted, the maintenance of markers and the associated cost may be reduced, and interference with the operation of the piece of equipment may be prevented.

Figure 1B:
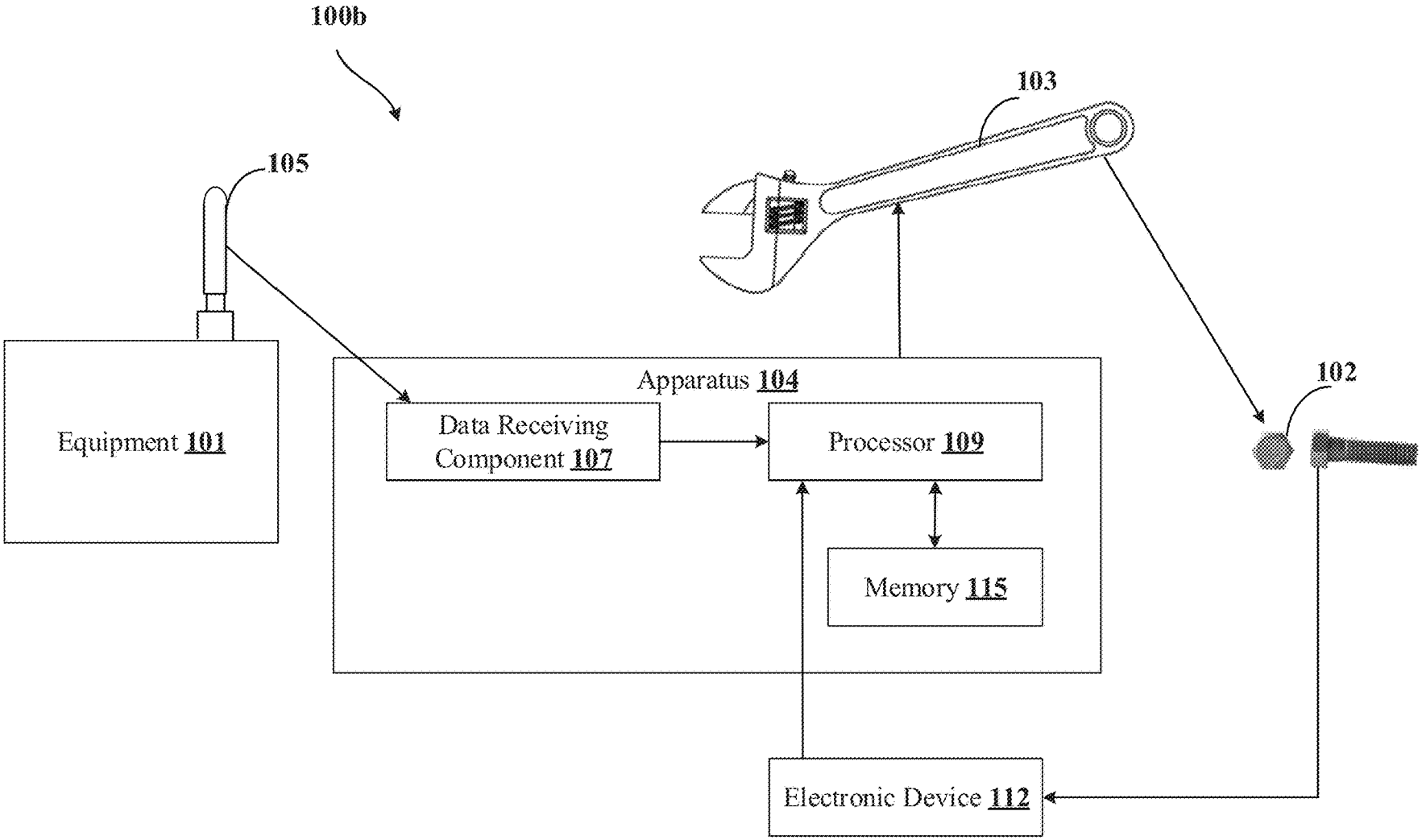
Figure 1C:
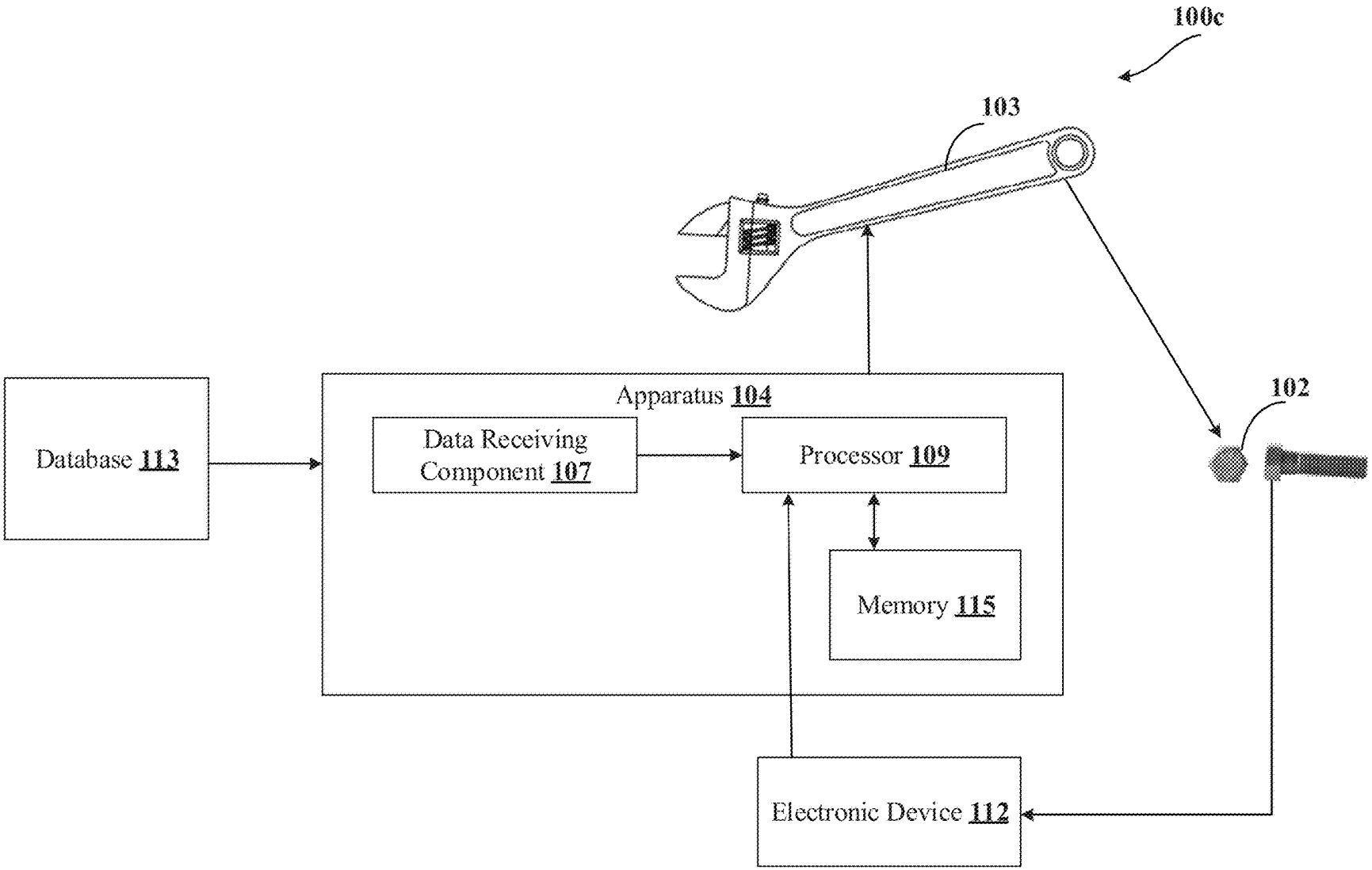

FIGS. 1*a* to 1*c* each show an exemplary environment for automatically adjusting the torque of a fastener of a piece of equipment according to an exemplary embodiment of the present disclosure.

Referring to FIG. 1*a*, in an exemplary embodiment, the environment 100*a* may include a piece of equipment 101, a wrench device 103, and one or more fasteners 102. The piece of equipment 101 may be, for example, a medical device or a fabrication device (e.g., a semiconductor fabrication device). However, the piece of equipment 101 is not limited thereto.

The piece of equipment 101 may include a transceiver 105. The transceiver 105 may be, for example, a light tower which implements, but is not limited to, Light Fidelity (Li-Fi) wireless communication, or Extremely High Frequency (EHF) wireless communication such as Millimeter Waves (MMW) wireless communication. When the transceiver 105 includes a light tower, the light tower may include one or more light emitting diodes (LEDs), which are used for wireless data transmission (e.g., data is wirelessly transmitted via the one or more LEDs). The transceiver 105 may select one of the plurality of LEDs and transmits the information related to the one or more fasteners 102 through the selected LED, and a photodiode may receive the information related to the one or more fasteners from the selected LED.

The wrench device 103 may be associated with the piece of equipment 101 and the one or more fasteners 102 for which the torque value is to be determined. In an exemplary embodiment, the wrench device 103 may include a data receiving component 107, an image sensor 111, a processor 109, and a memory 115 communicatively coupled to the processor 109. The memory 115 may store processor-executable instructions which, when executed by the processor 109, cause the processor to implement the operations described herein. The data receiving component 107 may be configured to receive information associated with the one or more fasteners 102 in the piece of equipment 101. The data receiving component 107 may be, for example, a photodiode. The data receiving component 107 may also be referred to herein as a data receiving circuit (e.g., a diode circuit).

Figure 1D:
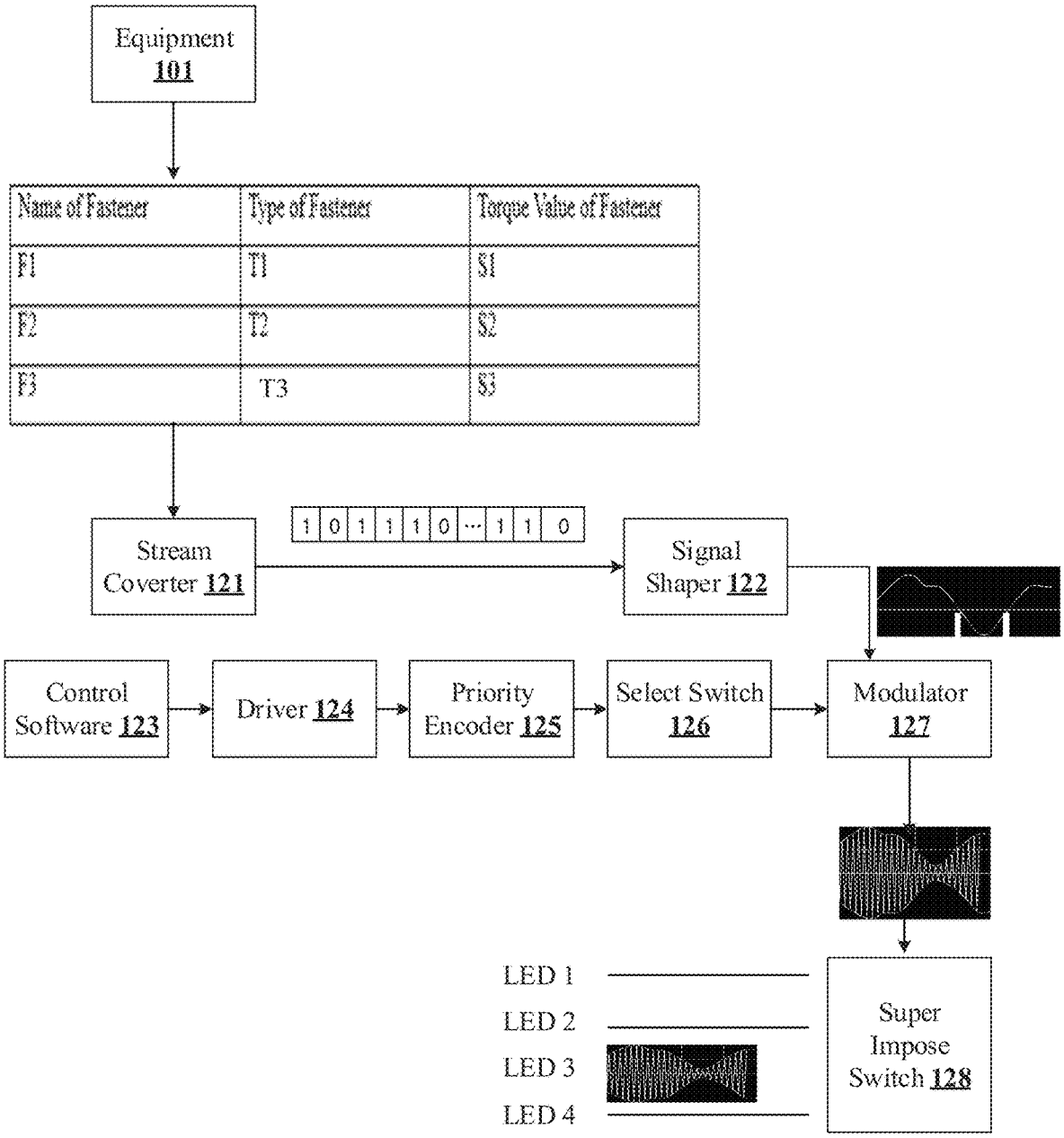
FIG. 1*d* illustrates a process of transmitting information from a piece of equipment through a light tower to a photodiode according to an exemplary embodiment of the present disclosure.

The information may include an image of each of the one or more fasteners 102, an identification number of each of the one or more fasteners 102, a type of each of the one or more fasteners 102, and/or a torque value corresponding to each of the one or more fasteners 102. When the transceiver 105 is implemented as a light tower and the data receiving component 107 is implemented as a photodiode, the information is transmitted from the piece of equipment 101 through the light tower to the photodiode. The process of transmitting the information is illustrated in FIG. 1*d*. The photodiode may in turn provide the information to the processor 109. The processor 109 may correlate the received information with the image of the one or more fasteners 102 captured by the image sensor 111 of the wrench device 103. When the images match, the processor 109 may identify the fastener 102 and also the type of the fastener 102 based on the received information. The processor 109 may further extract the torque value corresponding to the identified fastener 102 based on the received information. Once the torque value is identified, the wrench device 103 may perform a fastening operation on the fastener 102 based on the torque value corresponding to the fastener 102. In an exemplary embodiment, the image sensor 111 may capture an image of a fastener 102 upon the wrench device 103 performing the fastening operation, and may store the image in the memory 115.

Referring to FIG. 1*b*, in an exemplary embodiment, an environment 100*b* may include an apparatus 104 associated with the piece of equipment 101, the wrench device 103, an electronic device 112, and the one or more fasteners 102. For convenience of explanation, a further description of elements and technical aspects previously described may be omitted when describing FIG. 1*b*.

The apparatus 104 may include, for example, the data receiving component 107, the processor 109, and the memory 115. Thus, unlike the environment 100*a* of FIG. 1*a*, in the environment of FIG. 1*b*, the data receiving component 107 and the processor 109 are not included in the wrench device 103, but rather, are included in the apparatus 104, which is separate from the wrench device 103. In the environment 100*b* of FIG. 1*b*, the information associated with the one or more fasteners 102 that is received by the data receiving component 107 may include, for example, an image of each of the one or more fasteners 102, a type of each of the one or more fasteners 102, and/or a torque value corresponding to each of the one or more fasteners 102. The electronic device 112 may be, for example, an image capturing device such as a camera.

Referring to FIG. 1*c*, in an exemplary embodiment, an environment 100*c* may include the apparatus 104 associated with the piece of equipment 101, the wrench device 103, the electronic device 112, and the one or more fasteners 102. For convenience of explanation, a further description of elements and technical aspects previously described may be omitted when describing FIG. 1*c*.

The apparatus 104 may be associated with a database 113 which stores information such as, for example, an image of each of the one or more fasteners 102, a type of each of the one or more fasteners 102, and/or a torque value corresponding to each of the one or more fasteners 102. The database 113 may be remotely located relative to the apparatus 104, and the apparatus 104 may be in communication with the database 113. In the environment 100*c* of FIG. 1*c*, the apparatus 104 may retrieve the information from the database 113 instead of being connected to the piece of equipment 101 to receive the information corresponding to the one or more fasteners 102, as is the case in the environment 100*b* of FIG. 1*b*.

Once the information is received, the processor 109 included in the apparatus 104 may correlate the received information with images of the one or more fasteners 102. The images of the one or more fasteners 102 may be obtained from the electronic device 112 associated with the apparatus 104. Based on the correlation, the processor 109 may identify the one or more fasteners 102 and the corresponding torque values to be applied to the one or more fasteners 102. Thus, the apparatus 104 may provide the information of the torque values to be applied to the one or more fasteners 102 to the wrench device 103, and the wrench device 103 may perform the fastening operation on the one or more fasteners 102 based on the corresponding torque values.

Although FIG. 1*c* illustrates an environment 100*c* in which the data receiving component 107 and the processor 109 are included in the apparatus 104, exemplary embodiments are not limited thereto. For example, in an exemplary embodiment, in the environment 100*c* of FIG. 1*c*, the data receiving component 107 and the processor 109 may instead be included in the wrench device 103, and the wrench device 103 may be in communication with the database 113 without the apparatus 104. In addition, in the environment 100*c* according to an exemplary embodiment, the electronic device 112 may be omitted, and the wrench device may include the image sensor 111, which may serve the purpose of the electronic device 112.

FIG. 1*d* illustrates a process of transmitting information from the piece of equipment 101 through the transceiver 105 to the data receiving component 107. In FIG. 1*d*, it is assumed that the transceiver 105 includes a light tower, and the data receiving component 107 is implemented as a photodiode.

Referring to FIG. 1*d*, F1, F2, and F3 refer to the one or more fasteners 102. The information associated with the one or more fasteners F1, F2, and F3 is provided to a stream converter 121. The stream converter 121 provides a binary form of the information to a signal shaper 122. The signal shaper 122 converts the binary form into a signal which is provided to a modulator 127. Control software 123 and a driver 124, which may be included in the piece of equipment 101, may identify the LEDs of the light tower through which the information is to be transmitted. In an exemplary embodiment, the light tower may include 4 LEDs (LED 1, LED 2, LED 3, and LED 4). However, the light tower is not limited thereto. The control software 123 may detect that the information may be transmitted through LED 3 and LED 4, and thus, both LED 3 and LED 4 may be active. A priority encoder 125 may select LED 3 irrespective of the active status of LED 4, and this selection may be provided to the modulator 127 through a select switch 126. The modulator 127 may provide the information in the form of the modulated signal to a super impose switch 128. The super impose switch 128 may provide the information through the LED 3 to the photodiode.

In FIG. 1*d*, T1, T2, and T3 refer to the respective types of the fasteners F1, F2, and F3, and S1, S2, and S3 refer to the respective torque values corresponding to the fasteners F1, F2, and F3, as described below with reference to FIG. 2.

Figure 2:
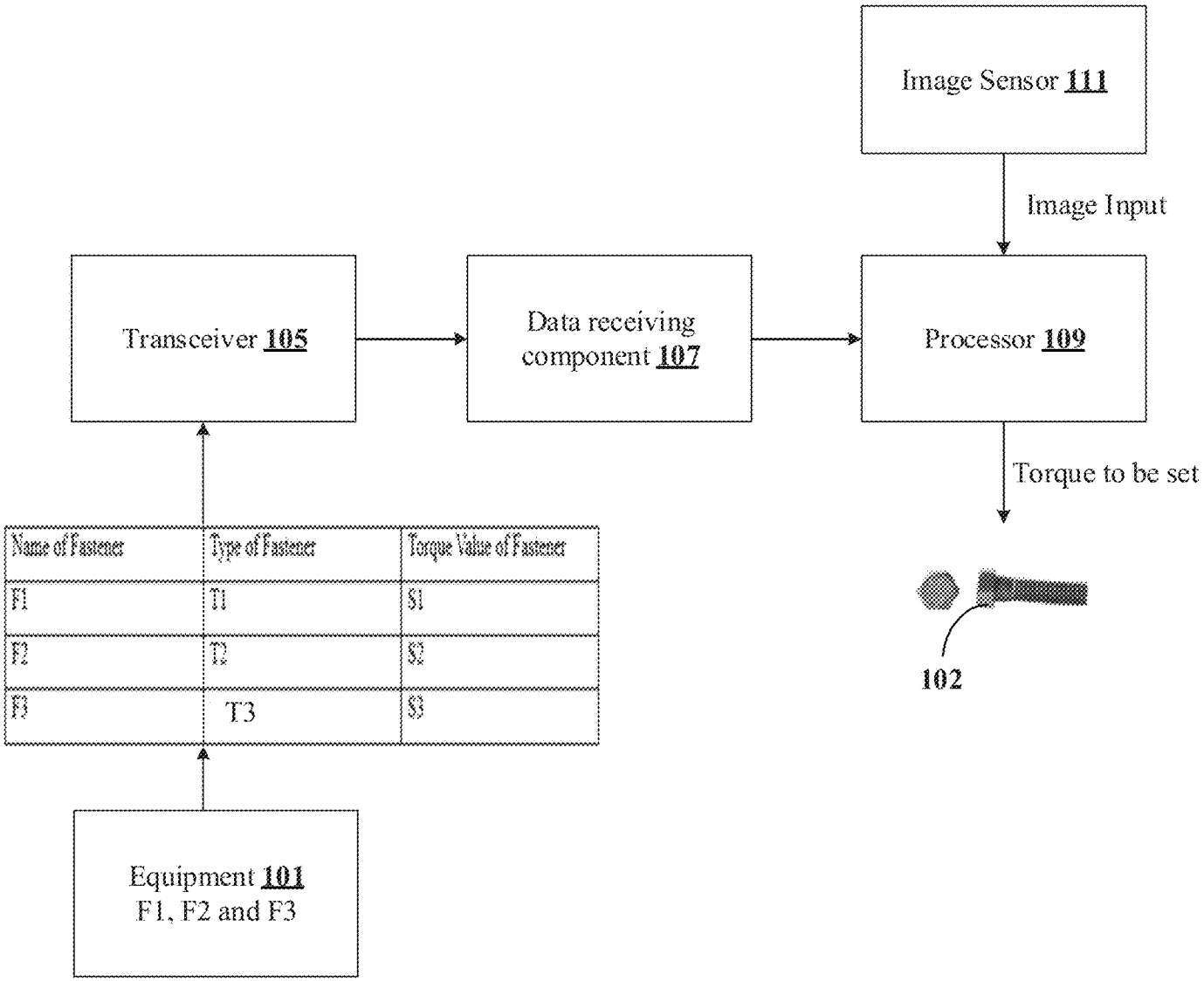
FIG. 2 shows an exemplary scenario illustrating a process of automatically adjusting the torque of a fastener of a piece of equipment according to an exemplary embodiment of the present disclosure.

FIG. 2 shows an exemplary scenario illustrating a process of automatically adjusting the torque of a fastener among the one or more fasteners 102 of the piece of equipment 101 according to an exemplary embodiment.

Referring to FIG. 2, an environment includes the transceiver 105, the data receiving component 107, the processor 109, the image sensor 111, and the one or more fasteners 102. The transceiver 105 may be included in the piece of equipment 101, and may send information related to the one or more fasteners 102 included in the piece of equipment 101. For convenience of explanation, a further description of elements and technical aspects previously described may be omitted when describing FIG. 2.

In the exemplary scenario, assume that three fasteners 102 are included in the piece of equipment 101 (e.g., fasteners F1, F2, and F3), and that the information includes the type of each fastener 102, the torque value associated with each fastener 102, and an image of each fastener 102. In an exemplary embodiment, the corresponding torque value associated with each fastener 102 is obtained by a training network. In the training network, one or more images of the one or more fasteners 102 may be trained and stored using, for example, a machine learning network. The one or more images of the one or more fasteners 102 may be compared with a reference image to identify a closest match of the image using a predefined technique, which may include, but is not limited to, a k-nearest neighbor (k-NN) technique. Once the closest matching image is identified, the corresponding torque value is obtained and is associated with each fastener 102.

The information associated with the three fasteners F1, F2 and F3 is provided below in Table 1:

TABLE 1

| Name of Fastener | Type of Fastener | Torque Value of Fastener |
|---|---|---|
| F1 | T1 | S1 |
| F2 | T2 | S2 |
| F3 | T3 | S3 |

As shown in Table 1, in the exemplary scenario, the fastener F1 is of type T1 and the corresponding torque value is S1, the fastener F2 is of type T2 and the corresponding torque value is S2, and the fastener F3 is of type T3 and the corresponding torque value is S3. The transceiver 105 transmits the information to the data receiving component 107 of the wrench device 103. The data receiving component 107 included in the wrench device 103 receives the information and provides the information to the processor 109. The image sensor 111 associated with the processor 109 captures an image of the fastener 102 and provides the image to the processor 109. The processor 109 compares the received image with the one or more images to identify the fastener 102. The processor 109 may use any image matching technique to identify the fastener 102 based on the image comparison. In the exemplary scenario, assume that the received image matches the image corresponding to the fastener F2. Therefore, the processor 109 identifies the fastener as F2 and extracts the torque value corresponding to F2. The torque value corresponding to F2 is S2. The processor 109 provides the extracted torque value to the wrench device 103, and the wrench device 103 applies the torque value S2 on the fastener. This process may be performed for a single fastener 102 or repeated for multiple fasteners 102.

The process described above with reference to FIG. 2, or a similar process, may be performed in any of the environments (e.g., 100*a*, 100*b*, 100*c*) described herein.

Figure 3:
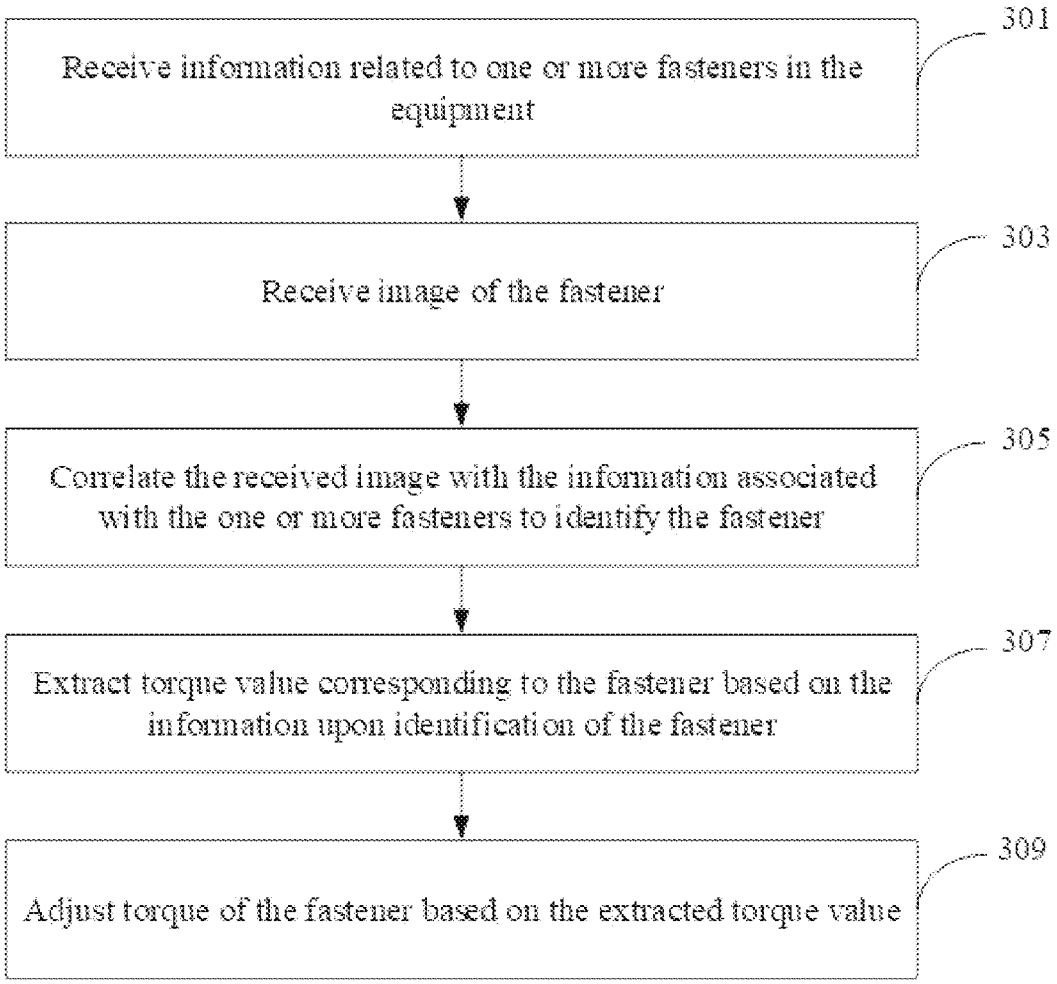
FIG. 3 shows a flowchart illustrating a method of automatically adjusting the torque of a fastener of a piece of equipment according to an exemplary embodiment of the present disclosure.

FIG. 3 shows a flowchart illustrating a method of automatically adjusting the torque of a fastener 102 of the piece of equipment 101 according to an exemplary embodiment.

Referring to FIG. 3, the flowchart includes one or more blocks illustrating a method of adjusting the torque of a fastener 102 of the piece of equipment 101. The method may be described herein in the general context of computer executable instructions. Computer executable instructions may include, for example, routines, programs, objects, components, data structures, procedures, modules, functions, etc. which perform specific functions or implement specific abstract data types.

The order in which the blocks in FIG. 3 occur is not limited to the order shown in FIG. 3. For example, in exemplary embodiments, at least some of the described blocks may be combined in a different order than the order shown in FIG. 3 to implement the method. Additionally, in exemplary embodiments, some of the blocks may be omitted. Furthermore, the method can be implemented in any suitable hardware, software, firmware, or a combination thereof.

It is to be understood that the method described with reference to FIG. 3 may be implemented in any of the environments (e.g., 100*a*, 100*b*, 100*c*) described herein. Further, for convenience of explanation, a further description of elements and technical aspects previously described may be omitted when describing FIG. 3.

At block 301, the method may include receiving information related to the one or more fasteners 102 included in the piece of equipment 101. For example, the wrench device 103 may receive the information from the transceiver 105 included in the piece of equipment 101, as described with reference to FIG. 1*a*. In another example, the apparatus 104 may receive the information from the transceiver 105 included in the piece of equipment 101, as described with reference to FIG. 1*b*. In another example, the apparatus 104 may receive the information from the database 113, as described with reference to FIG. 1*c*.

At block 303, the method may include receiving an image of the fastener 102. The image may be received, for example, from the image sensor 111 associated with the wrench device 103 or from the electronic device 112. The captured image of the fastener 102 may be transmitted to the processor 109.

At block 305, the processor 109 may correlate the received image with the information received from the piece of equipment 101 or the database 113. Based on the comparison, the processor 109 may identify the fastener 102.

At block 307, the method may include extracting the torque value corresponding to the fastener 102. For example, once the fastener 102 is identified, the processor 109 may extract the torque value corresponding to the identified fastener 102.

At block 309, the processor 109 may adjust the torque value of the identified fastener 102 based on the extracted torque value. The wrench device 103 may apply the torque value when adjusting the fastener 102.

Exemplary embodiments of the present disclosure provide a wrench device 103 that automatically adjusts the torque of a fastener 102 of a piece of equipment 101. Exemplary embodiments may reduce the maintenance of markers, and thus, may reduce the associated cost of operating and maintaining the piece of equipment 101.

In a comparative example, wireless communication such as, for example, Radio Frequency Identification (RFID) based communication, may be used to transmit information to and from the wrench device 103. However, in many applications, particularly semiconductor manufacturing, using wireless communication such as RFID based communication may interfere with the working of the piece of equipment 101. In contrast, since exemplary embodiments may utilize Li-Fi communication instead of RF communication, interference with the working of the piece of equipment 101 may be prevented.

When a single device is described herein, it will be clear that more than one device (whether they cooperate) may be used in place of a single device. Similarly, where more than one device is described herein (whether they cooperate), it will be clear that a single device may be used in place of the more than one device, or a different number of devices may be used instead of the shown number of devices. The functionality and/or the features of a device may be alternatively embodied by one or more other devices which are not explicitly described as having such functionality/features. Thus, other exemplary embodiments of the disclosure need not include the device itself.

As is traditional in the field of the present disclosure, exemplary embodiments are described, and illustrated in the drawings, in terms of functional blocks, units and/or modules. Those skilled in the art will appreciate that these blocks, units and/or modules are physically implemented by electronic (or optical) circuits such as logic circuits, discrete components, microprocessors, hard-wired circuits, memory elements, wiring connections, etc., which may be formed using semiconductor-based fabrication techniques or other manufacturing technologies. In the case of the blocks, units and/or modules being implemented by microprocessors or similar, they may be programmed using software (e.g., microcode) to perform various functions discussed herein and may optionally be driven by firmware and/or software. Alternatively, each block, unit and/or module may be implemented by dedicated hardware, or as a combination of dedicated hardware to perform some functions and a processor (e.g., one or more programmed microprocessors and associated circuitry) to perform other functions.

Also, each block, unit and/or module of the exemplary embodiments may be physically separated into two or more interacting and discrete blocks, units and/or modules without departing from the scope of the present disclosure. Further, the blocks, units and/or modules of the exemplary embodiments may be physically combined into more complex blocks, units and/or modules without departing from the scope of the present disclosure.

As will be appreciated by one skilled in the art, aspects of the present disclosure may be embodied as a system, method or computer program product. Accordingly, aspects of the present disclosure may take the form of an entirely hardware embodiment, an entirely software embodiment (including firmware, resident software, micro-code, etc.) or an embodiment combining software and hardware aspects that may all generally be referred to herein as a "circuit," "module", or "system." Furthermore, aspects of the present disclosure may take the form of a computer program product embodied in one or more computer readable medium(s) having computer readable program code embodied thereon.

Herein, the term "circuit" may refer to an analog circuit or a digital circuit. In the case of a digital circuit, the digital circuit may be hard-wired to perform the corresponding tasks of the circuit, such as a digital processor that executes instructions to perform the corresponding tasks of the circuit. Examples of such a processor include an application-specific integrated circuit (ASIC) and a field-programmable gate array (FPGA).

While the present disclosure has been particularly shown and described with reference to the exemplary embodiments thereof, it will be understood by those of ordinary skill in the art that various changes in form and detail may be made therein without departing from the spirit and scope of the present disclosure as defined by the following claims.

What is claimed is:

1. An apparatus, comprising: a wrench comprising a handle, an adjustment mechanism, and jaws;

a data receiving component included with the handle or jaw, said data receiving component configured to receive, from a transceiver associated with a piece of equipment, information related to a fastener included in the piece of equipment, and a torque value corresponding to the fastener;

an image sensor configured to capture an image of the fastener;

a processor; and a memory communicatively coupled to the processor, wherein the memory stores processor-executable instructions, which, on execution, cause the processor to:

receive the image of the fastener from the image sensor;

receive the information related to the fastener from the data receiving component;

identify the fastener by correlating the received image with the information related to the fastener;

extract the torque value corresponding to the fastener based on the information upon identification of the fastener; and adjust a torque of the fastener based on the extracted torque value.

2. The wrench device of claim 1, wherein the data receiving component is a photodiode, the transceiver comprises a light tower included in the piece of equipment, and the photodiode and the light tower communicate with each other via at least one of Light Fidelity (Li-Fi) based wireless communication or Millimeter Waves (MMW) based wireless communication.

3. The wrench device of claim 2, wherein the light tower comprises a plurality of LEDs, the transceiver selects one of the plurality of LEDs and transmits the information related to the fastener though the selected LED, and the photodiode receives the information related to the fastener from the selected LED.

4. The wrench device of claim 1, wherein the wrench device is configured to perform a fastening operation on the fastener based on the torque value corresponding to the fastener.

5. The wrench device of claim 4, wherein the image sensor captures the image of the fastener upon performing the fastening operation, and stores the image in the memory.

6. The wrench device of claim 1, wherein the fastener is one of a plurality of fasteners, and the information comprises an image of each of the plurality of fasteners, an identification number associated with each of the plurality of fasteners, a type of each of the plurality of fasteners, and a torque value corresponding to each of the plurality of fasteners.

7. The wrench device of claim 1, wherein the information related to the fastener is retrieved from a database associated with the wrench device.

* * * * *